US010605532B2

(12) United States Patent
Aumann et al.

(10) Patent No.: US 10,605,532 B2
(45) Date of Patent: Mar. 31, 2020

(54) DEVICE AND METHOD FOR CONDENSATION OF STEAM FROM ORC SYSTEMS

(75) Inventors: Richard Aumann, Munich (DE); Andreas Schuster, Tussenhausen (DE); Andreas Sichert, Munich (DE)

(73) Assignee: Orcan Energy AG, München (DE)

( * ) Notice: Subject to any disclaimer, the term of this patent is extended or adjusted under 35 U.S.C. 154(b) by 601 days.

(21) Appl. No.: 14/241,676

(22) PCT Filed: Sep. 5, 2012

(86) PCT No.: PCT/EP2012/003730
§ 371 (c)(1),
(2), (4) Date: May 24, 2016

(87) PCT Pub. No.: WO2013/045021
PCT Pub. Date: Apr. 4, 2013

(65) Prior Publication Data

US 2017/0307297 A1 Oct. 26, 2017

(30) Foreign Application Priority Data

Sep. 28, 2011 (EP) ..... 11007883

(51) Int. Cl.

| | |
|---|---|
| ***F28B 9/08*** | (2006.01) |
| ***F01K 9/00*** | (2006.01) |
| ***F01K 25/10*** | (2006.01) |
| ***F28B 1/02*** | (2006.01) |
| ***F28B 1/06*** | (2006.01) |

(52) U.S. Cl.
CPC ..... *F28B 9/08* (2013.01); *F01K 9/00* (2013.01); *F01K 25/10* (2013.01); *F28B 1/02* (2013.01); *F28B 1/06* (2013.01)

(58) Field of Classification Search
CPC ..... F28B 1/00; F28B 1/02; F28B 1/06; F28B 3/00; F28B 9/08; F01K 9/00; F01K 25/10; F24F 13/22; F24F 13/222; F24F 2013/227
USPC ..... 165/110, 111, 112; 62/509
See application file for complete search history.

(56) References Cited

U.S. PATENT DOCUMENTS 1,761,551 A * 6/1930 *Weaver ..... F25B 1/08 62/114
2,604,306 A * 7/1952 *Berry ..... F25B 29/006 165/62
3,315,879 A * 4/1967 *Jennings ..... F28B 9/10 417/54
3,675,710 A * 7/1972 Ristow ..... F28B 1/00 165/109.1
4,141,410 A * 2/1979 Takada ..... B01D 1/04 165/113

(Continued)

*Primary Examiner* — Keith M Raymond
*Assistant Examiner* — Gustavo A Hincapie Serna
(74) *Attorney, Agent, or Firm* — Moore & Van Allen PLLC; Henry B. Ward, III

(57) ABSTRACT

The invention relates to a device for condensation of vapour expanded in an expansion machine of a thermal power plant to a condensed liquid, in particular containing oil, comprising: a module for condensation, wherein for condensation the module comprises an inlet and one or more pipelines, for example having substantially horizontally disposed pipes; a liquid separator for separating the condensed liquid; and a liquid collector for collecting the separated, condensed liquid.

10 Claims, 4 Drawing Sheets

(56) References Cited

U.S. PATENT DOCUMENTS

| | | | | | |
|---|---|---|---|---|---|
| 4,165,783 | A * | 8/1979 | Oplatka | F22G 1/005 | 122/483 |
| 5,115,645 | A * | 5/1992 | Abraham | B01D 5/0039 | 165/140 |
| 5,141,048 | A * | 8/1992 | Sausner | F28B 1/06 | 165/110 |
| 5,159,821 | A * | 11/1992 | Nakamura | F25B 39/04 | 165/110 |
| 5,507,356 | A * | 4/1996 | Roth | B01D 3/14 | 165/111 |
| 5,653,281 | A * | 8/1997 | Berg | F28B 1/06 | 165/113 |
| 5,692,389 | A * | 12/1997 | Lord | F25B 5/02 | 62/218 |
| 5,755,113 | A * | 5/1998 | Ferguson | F25B 39/04 | 165/DIG. 197 |
| 5,913,362 | A * | 6/1999 | Jun | F25B 39/04 | 165/110 |
| 6,477,858 | B2 * | 11/2002 | Nobuta | F25B 39/04 | 62/509 |
| 6,953,083 | B2 * | 10/2005 | Kawakami | B01D 5/0012 | 165/114 |
| 7,093,461 | B2 * | 8/2006 | Patel | F25B 39/04 | 62/509 |
| 7,237,406 | B2 * | 7/2007 | Voss | B01D 5/0009 | 165/111 |
| 2007/0137590 | A1 * | 6/2007 | Vetrovec | F01N 5/02 | 123/25 A |
| 2007/0193872 | A1 * | 8/2007 | Garcia | B01D 1/0035 | 202/234 |
| 2009/0107887 | A1 * | 4/2009 | Frye | B01D 3/14 | 208/130 |

* cited by examiner

DEVICE AND METHOD FOR CONDENSATION OF STEAM FROM ORC SYSTEMS

FIELD OF THE INVENTION

The present invention relates to a device and method for the condensation of vapor expanded in an expansion machine of a thermal power plant to a condensed, in particular oil-containing liquid.

BACKGROUND OF THE INVENTION

The operation of expansion machines, such as steam turbines or displacement machines, e.g. piston engines, by means of the Organic Rankine Cycle (ORC) method for the generation of electric energy through the use of organic media, e.g. organic media having a low evaporation temperature, which generally have higher evaporation pressures at the same temperatures as compared to water as working medium, is known in the prior art. ORC plants constitute a realization of the Rankine cycle in which electric energy is basically obtained, for example, by means of adiabatic and isobaric changes of condition of a working medium. Mechanical energy is generated by the evaporation, expansion and subsequent condensation of the working medium, and is converted into electric energy. Basically, the working medium is brought to an operating pressure by a feed pump, and energy in the form of heat, which is provided by a combustion or a flow of waste heat, is supplied to the working medium in a heat exchanger. The working medium flows from the evaporator through a pressure pipe to an expansion machine of an ORC system where it is expanded to a lower pressure. Subsequently, the expanded working medium vapor flows through a condenser in which a heat exchange takes place between the vaporous working medium and a cooling medium. Then, the condensed working medium is fed by a feed pump back to the evaporator in a cycle.

The advantage of using Organic Rankine Cycle systems, in particular for the utilization of low-temperature heat, is sufficiently known. Particularly in the range of relatively small system powers, for example in the range of 1 kW to approximately 50 kW, displacement machines are used frequently. These displacement machines may be piston engines. These machines need a certain amount of oil as lubricant in the machine. In the machine cycle the oil in the cycle usually circulates together with the working medium. In doing so, the oil particularly also passes the condenser of the system, which may result in an higher pressure loss in the condensation.

Condensers used in the field of refrigeration engineering and air conditioning technology, so-called liquefiers, can be regarded as prior art. In refrigeration engineering vapor is condensed after the compression at a high pressure and a relatively high temperature. The vapor, when entering the condenser, has a relatively high density. In order to obtain sufficiently high flow speeds the vapor volume flow is distributed to a few pipelines which then run through the individual levels of the condenser.

The condenser typically has an inlet and an outlet between which the pipelines are arranged, in which the major part of the condensation takes place. Often, the pipes of the pipelines are arranged substantially horizontally. In horizontal arrangements the condensate furthermore requires a driving force so as to flow to the outlet of the condenser. To this end, the vapor and the condensate have to flow in a parallel flow.

The condensate is "blown" by the vapor through the pipes. The transport of the condensate by means of the vapor requires energy. This results in a pressure loss inside the condenser, and the pressure loss between the entry of the vapor into the condenser and the discharge of the condensate can be measured. The pressure loss increases quadratically with the flow speed of the vapor in a turbulent flow. Moreover, the pressure loss depends on the viscosity of the liquid. In particular, the pressure loss increases with the viscosity of the liquid.

The above-mentioned oil in the displacement machines is used, for example, for lubricating flanks and bearings. In other words, components gliding along one another and/or rolling upon one another are lubricated. The oil takes part in the machine cycle. One can furthermore talk about a fluid representing a mixture of the actual working medium of the machine and the oil, respectively an oil-containing liquid.

The oil passes the expansion machine jointly with the vapor, and is discharged from the expansion machine, for example, in the form of an oil-vapor spray or oil-vapor mist. That is, liquid is already contained in the vapor at the inlet of the condenser, meaning while the greater portion of the vapor is still present in the form of a vaporous working medium, one portion of the vapor is already mixed, at least partially, with oil-containing liquid droplets upon entering the condenser or even upstream of the inlet into the condenser. At the beginning, i.e. near the inlet of the condenser, only little condensate is separated, the oil portion in this condensate being very high. Practically, it is almost pure oil. Correspondingly, the viscosity of this separated liquid is very high. This may entail very high pressure losses, which are disadvantageous for the condenser. These pressure losses may, again, reduce the performance of the entire system, in particular of the expansion machine, so that eventually the efficiency of the process as a whole is reduced. This may result in performance losses in the two-digit percent range.

In comparison with the air conditioning technology the working medium particularly in ORC systems is condensed at lower pressures. That is, the vapor has a lower density. A clearly greater volume flow is achieved with similar mass flows and condensation performances. With an identical construction of the condenser this stands for a greater speed of the vapor and, thus, clearly greater pressure losses.

An improvement of the condensation and a reduction of the pressure losses can be achieved by a more frequent division of the vapor volume flow. The problem of having oil or oil-like or oil-containing liquids in the system and pressure losses associated therewith persists, however.

Given the above-outlined problem in the prior art it is the object of the present invention to provide a device and a method for the condensation of vapor of an expansion machine of a thermal power plant, expanded in an expansion machine of a thermal power plant, so that the above-outlined disadvantages can be reduced or even eliminated and the performance losses associated therewith can be reduced or even overcome.

BRIEF SUMMARY OF THE INVENTION

The above-mentioned object is achieved by a device for the condensation of vapor expanded in an expansion machine of a thermal power plant to a condensed, in particular oil-containing liquid, according to the features of patent claim 1. Also, this object is achieved by a corresponding method for the condensation of vapor expanded in an expansion machine of a thermal power plant to a condensed, in particular oil-containing liquid, according to patent claim 12.

The invention provides a device for the condensation of vapor expanded in an expansion machine of a thermal power plant to a condensed, in particular oil-containing liquid, comprising: a module for condensation, wherein the module for condensation comprises an inlet as well as one or more pipelines, for example having substantially horizontally arranged pipes; a liquid separator for separating the condensed liquid: and a liquid collector for collecting the separated, condensed liquid.

Thus, the separation of the in particular oil-containing liquid from the expanded vapor may be accomplished in the device, so that the oil-containing liquid can flow out of the device for condensation, thus allowing a clear reduction of deposits on the inner walls of the pipes of the one or more pipelines.

The liquid in this context is a liquid which contains, at least partially, portions of oil and portions of a working medium of the thermal power plant.

A pipeline in this context is at least one substantially horizontally running pipe with a pipe bend sitting on one end thereof, which is capable of deflecting a fluid flow through the pipe about a fixed angle, e.g. 180°. However, other angles for the pipe bends are feasible, too, e.g. 90°. Typically, several pipelines can be coupled to each other.

In the device as described above the liquid separator may be provided, in particular, upstream of or at the inlet and/or downstream of the first pipeline: wherein the liquid collector comprises a branch pipe configured to divert at least one portion of the separated, condensed liquid out of the device.

The device for the condensation, i.e. the condenser, may be set up at a distance or even physically separated from the expansion machine. Thus, considerable lengths of connecting pipes of, for example, some meters to some 10 meters can occur. In this respect, it may be possible to already provide a liquid separator upstream of the inlet of the condenser, e.g. immediately before a connecting pipe feeds the vapor expanded by the expansion machine into the device for condensation. This means, this liquid separator may be provided substantially immediately upstream of or at the inlet of the device. Same can separate liquid already condensed in the connecting pipe from the connecting pipe, so that this liquid, or at least one portion of this liquid, does not enter into the device at all. Correspondingly, such a liquid separator may also be provided immediately downstream of the inlet of the device. Additionally or alternatively a liquid separator may typically be provided downstream of the first pipeline of the module of the device. Thus, at least one portion of the oil-containing liquid can already be separated at an early stage, so that as little oil-containing liquid as possible flows through the device or even up to the outlet of the device.

In the device as described above the liquid separator may comprise a siphon which is arranged between the branch pipe and the liquid collector.

By using a siphon, i.e. a U-bend pipe, a defined flow direction of the fluid, i.e. the mixture of vapor and liquid, inside the device may be supported. Typically, the liquid stands in the siphon. Due to the height difference of the liquid column, up to a maximum pressure difference substantially only liquid flows through the siphon, and substantially no vapor.

In the device as described above the liquid separator may comprise a condensate drain having a conduit and a float, which is arranged between the branch pipe and the liquid collector. In particular, the condensate drain can drain off condensate formed in the device, for example, when the system is started. This may be accomplished, for example, by a float provided in the condensate drain. If condensate is present, the float opens the liquid drain. Thus, condensate "standing" in the device can be drained off. Upon draining off the condensate, i.e. upon emptying the drain, the liquid drain is closed again by the float.

Also, it is possible that a device comprises a liquid separator having a siphon and another liquid separator having a condensate drain. Other combinations of several siphons and/or condensate drains are possible, too.

Typically, if a siphon is used, no other mobile parts are required. The pressure loss via the siphon should be greater than or equal to the pressure loss via the remaining path through the device.

The device as described above may furthermore comprise a cooling device configured to cool the separated, condensed liquid before same is transferred into the liquid collector.

At the place where the oil-containing liquid is separated, the separated liquid may have a temperature which exceeds, for example, a desired, predefined value of the temperature of the liquid already collected in the liquid collector. An introduction of this separated, hotter liquid into the liquid collector could, thus, result in an undesired temperature rise of the liquid in the liquid collector. A cooling of the drain site, i.e. substantially of the branch pipe, can avoid such a temperature introduction into the liquid collector. In this respect it is also possible to use, for example, an air volume flow of the device, the condenser, in addition to an additional cooling device.

In the device as described above the liquid collector may be a feed container, or the one or more pipelines may additionally be configured, at least partially, as liquid collector(s).

This means that a separate feed container is capable of receiving the liquid separated from the device. This feed container can then be connected, for example, to a pump, e.g. a feed pump, to pump liquid back to the cycle.

Also, it is possible to provide, additionally or alternatively, at least parts of one or more of the pipelines as liquid collector. Thus, no feed container is necessary for specific applications, or a reservoir of liquid/working medium may be provided in addition to a feed container, for example, if only a small feed container can be provided. Thus, the device can be designed in such a manner that a sufficiently great amount of liquid/working medium can be received in the lower region of the pipelines of the device. The liquid level in the corresponding pipelines may vary according to the load state. As heat transfers/heat transmissions may occur also in the region of the liquid/working medium stock an additional supercooling may take place. Thus, for example, cavities may be avoided also in the dynamic operation.

In the device as described above the liquid separator may be a first liquid separator. The device may further comprise at least one further pipeline and at least one further liquid separator corresponding to the first liquid separator, wherein the further liquid separator is arranged downstream of the at least one further pipeline, and is configured to divert at least one further portion of the separated, condensed liquid out of the device.

If several pipelines are provided it is, thus, possible to provide downstream of a first liquid separator, which, as described above, may be provided upstream or downstream of a first pipeline, further liquid separators downstream of further pipelines. This means that in or downstream of a further pipeline, or downstream of further pipelines, a further portion of liquid may be separated again so as to further reduce the pressure losses.

In the device as described above at least one further module for condensation may be provided, which corresponds to the module as described above; and further a collecting conduit may be provided, which is arranged upstream of the liquid separator, and which is configured to combine the expanded vapor after the passage thereof through the one or more pipelines and transfer it further to the further module for condensation.

For example, a device for condensation, condenser, as described above, may comprise several modules. These modules may also be referred to as levels. Typically, the modules are of the same type. The vapor volume flow for the first module may already be divided at the inlet of the device. As described above, a liquid separator may be provided upstream and/or downstream of the first module. Vapor not yet condensed may be transferred or transported further to the next module. To this end, a collecting conduit may be provided which combines the expanded vapor and transfers it further to the next module. The collecting conduit may be arranged upstream or downstream of the liquid separator.

In the device as described above the collecting conduit may have one single, central connection to a conduit for further transferring the expanded vapor, or several separate conduits for further transferring the expanded vapor.

This means that the collecting conduit may, for example, combine the expanded vapor in one single conduit and transfer it further. From this conduit the liquid separation can then take place. The collecting conduit may also be connected to a plurality of conduits each of which independently transfers a portion of the vapor further to the next module. The collecting conduit then transfers, for example, substantially condensed liquid out of the conduits for the liquid separation.

In the device as described above the collecting conduit may comprise a falling gradient towards the liquid separator.

By a falling gradient the gravitational force may be used to obtain a better drainage of the liquid. Typically, the inclination may be a predefined inclination of some degrees. The value of the inclination may be predefined, allowing the liquid to flow independently towards the liquid separation.

The present invention also provides a thermal power plant comprising a device for condensation as described above.

This means that the device as described above may be used in a thermal power plant, e.g. a plant utilizing a Clausius Cycle or an Organic Rankine Cycle.

The present invention further provides a method for the condensation of vapor expanded in an expansion machine of a thermal power plant to a condensed, in particular oil-containing liquid, comprising a module for condensation, wherein the module for condensation comprises one or more pipelines, for example having substantially horizontally arranged pipes; and a liquid separator, comprising the steps of: distributing a vapor volume flow to the one or more pipelines: separating at least one portion of the condensed, in particular oil-containing liquid upstream and/or downstream of the first pipeline; discharging the separated, condensed liquid; and collecting the separated, condensed liquid.

The statements already set forth above apply analogously to the method according to the invention.

The method as described above may further comprise the step of cooling the separated, condensed liquid before the liquid is collected.

The method as described above may further comprise the step of separating at least one further portion of the condensed, in particular oil-containing liquid downstream of at least one further pipeline.

In the method as described above at least one further module for condensation corresponding to the above-described module may be provided, and the method may further comprise the following steps of: combining the expanded vapor after having passed through the one or more pipeline(s); and transferring the combined, expanded vapor further to the further module for condensation.

Other features and exemplary embodiments and advantages of the present invention will be explained in more detail below by means of the appended drawings.

It will be appreciated that these exemplary embodiments do not limit the scope of the present invention. It will also be appreciated that some or all of the features described below may also be combined with one another in other ways.

DETAILED DESCRIPTION OF THE INVENTION

Figure 1:
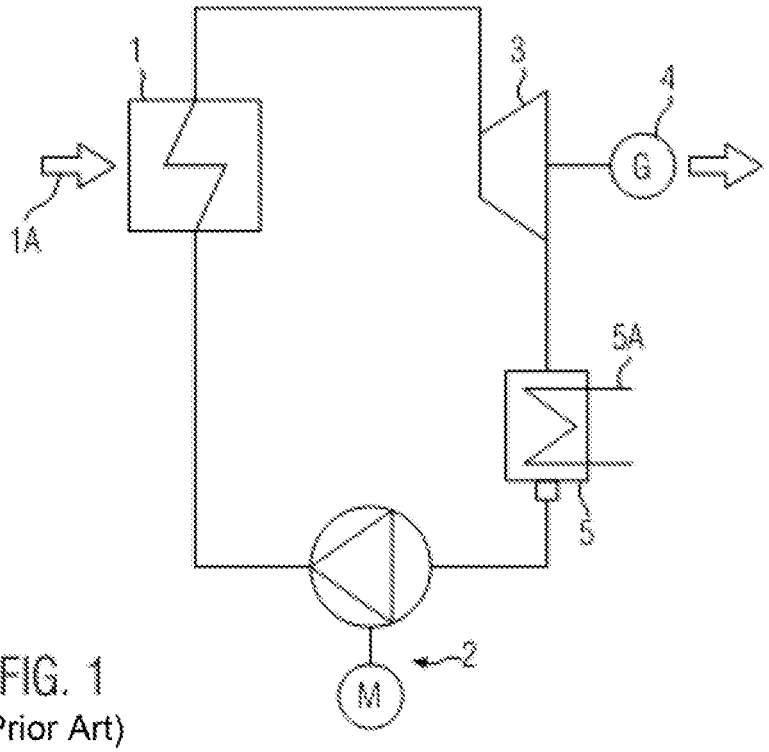
FIG. 1 (Prior Art)
FIG. 1 represents a schematic diagram of a conventional thermal power plant.

FIG. 1 shows pure schematically a conventional thermal power plant. This plant may be a Clausius Rankine plant or an Organic Rankine plant. The plant may, in principle, be operated with a direct evaporation, or with an intermediate cycle (not shown). FIG. 1 shows an evaporator 1 which may be, for example, a heat exchanger or heat transfer element. Heat from a heat source (not shown) may be supplied to the evaporator 1, for example, by a fluid, such as a flue gas. The supply of heat is exemplarily shown by the arrow 1A. In the evaporator 1 the heat from the fluid is transferred to a working medium working fluid. The working medium is supplied, for example, by a feed pump 2 to the evaporator 1. In the evaporator 1 the working medium is, for example, completely evaporated. It can also be evaporated by means of flash evaporation downstream of the heat transfer element. The working medium, which is now practically completely evaporated, is supplied by a suitable pressure line to an expansion machine 3. In the expansion machine 3 the pressurized vapor of the working medium may be expanded. By the expansion a generator 4 can be driven in a suitable manner.

The expansion machine 3 may be a displacement machine, e.g. a piston engine. Downstream of the expansion machine 3 the expanded working medium is transferred further to a condenser 5. In the condenser 5 the working medium is condensed. Heat of condensation thus produced may be dissipated by another heat transfer medium, which is designated with reference number 5A, or directly to a cooling medium, e.g. air. The heat transfer medium 5A may also be a cooling element. The working medium now liquified is transferred to the feed pump 2, and from there back to the evaporator 1. It will be appreciated that additional pumps may be employed in the system, which are not shown.

Figure 2:
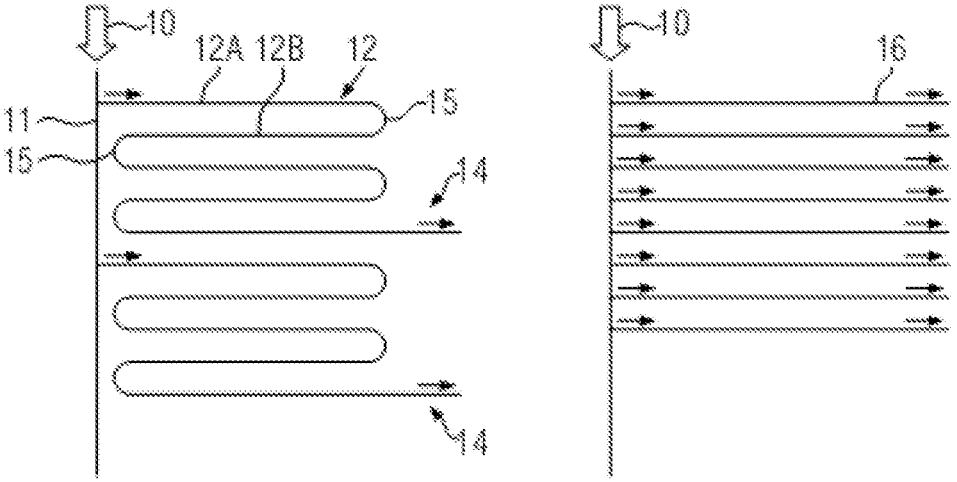
FIG. 2 (Prior Art)
FIG. 2 represents a schematic diagram for a division of a vapor volume flow in a conventional condenser of a thermal power plant.

FIG. 2 shows pure schematically a conventional interconnection of vapor inlets and pipelines used in air conditioning technology. A vapor flow is shown in the left half of FIG. 2, or vapor 10 is shown at an inlet of a condenser. An inlet conduit is designated with reference number 11. Reference number 12 designates a pipeline. The pipeline 12 consists of an upper pipe 12A and a lower pipe 12B. The two pipes 12A and 12B are connected by a pipe bend 15. In the example, the pipe bend 15 is configured as a "180° pipe bend". This means that the pipe bend 15 deflects the vapor flow by 180°. Several pipelines 12 are shown, before the vapor is directed to another module of the condenser or, upon the completed condensation, to a collecting conduit (not shown), as is indicated by reference number 14.

The right half of FIG. 2 depicts another possible interconnection of vapor inlets. The figure shows several distributions by several pipes 16 which transfer the vapor flow further to another module of the condenser or, if the condensation is already completed, to a collecting conduit (not shown). The pipes 16 may also be regarded as pipelines, however, without pipe bends.

Figure 3:
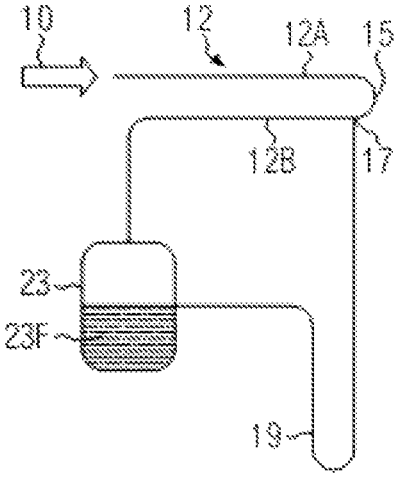
FIG. 3 schematically shows the separation of condensed liquid in a device for condensation according to an embodiment of the present invention.

FIG. 3 shows an embodiment of the present invention. Like elements, which were already introduced in FIGS. 1 and 2, are designated with like reference numbers.

In FIG. 3 a vapor flow 10, e.g. a vaporous working medium that was expanded in an expansion machine of a thermal power plant, is transferred into a device for condensation. The expansion machine may, in particular, be a displacement machine. In particular, the vaporous working medium 10, the vapor, may contain an oil portion, which may be present, for example, in the form of an oil-vapor spray.

FIG. 3 shows by way of an example a pipeline 12 having an upper pipe 12A and a lower pipe 12B. The two pipes 12A and 12B are connected by a pipe bend 15. Downstream of the pipe bend 15 a branch element 17 is provided. The branch element 17 may be a branch pipe, it is substantially possible to divert condensed liquid in the branch element 17 already downstream of the first pipeline 12, or already downstream of the first part of the first pipeline 12A. Vaporous working medium not diverted at the branch element 17 is transferred through conduit 12B to a feed container 23 and is condensed on its way to the feed container 23. A stock of liquid 23F is provided in the feed container 23. It will be appreciated that this liquid 23F, again, is a mixture of the oil-containing liquid and the actual working medium of the thermal power plant. The advantage of the diverting by means of the branch element 17 is that condensed liquid can be separated at an early stage. The liquid separated first may contain a high ratio of oil-containing liquid.

It will be appreciated that the limitation to substantially only one illustrated pipeline 12 is based on purely schematic reasons and merely serves to explain the principle. It is also possible to provide additional pipelines that substantially correspond to the pipeline 12.

Figure 4:
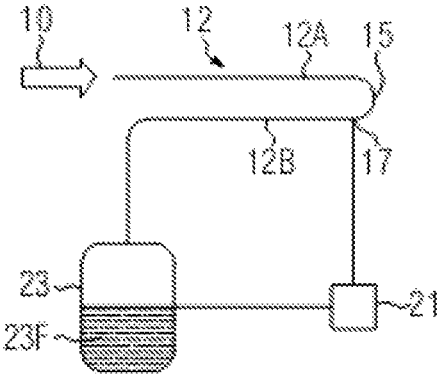
FIG. 4 schematically shows the separation of condensed liquid in a device for condensation according to another embodiment of the present invention.

FIG. 3 shows a siphon 19 downstream of the branch element 17. Owing to the height difference of the liquid column substantially only liquid stands in the siphon 19 up to an upper maximum pressure, and no vapor. This is outlined in more detail in FIG. 5. FIG. 4 shows a further development of the device for condensation corresponding to the present invention. Again, the illustration is a mere example and to be understood schematically. Similar to FIG. 3, the limitation to only one pipeline 12, including elements 12A and 12B and a pipe bend 15, only serves to explain the principle. It is possible, of course, to provide additional pipelines 12 in the device. Like FIG. 3, FIG. 4 shows a branch element 17. The branch element 17 is configured, similar to the embodiment shown in FIG. 3, to divert condensed liquid, i.e. condensate, out of the pipeline 12. Vaporous working medium not diverted at the branch element 17 is transferred further through the conduit/pipe 12B of the pipeline 12 to the feed container 23. Again, a liquid level 23F is shown in the feed container 23.

FIG. 4 shows a condensate draining element/a condensate drain 21 instead of the siphon 19 as used in FIG. 3. The condensate drain 21 can include, for example, a float element/float (not shown). The float may be lifted in the presence of condensate in the condensate drain, e.g. by the condensate itself, allowing the condensate to be drained. The different specific weight of liquid and vapor is used, for example, to separate the liquid from the vapor. In principle, also condensate drains may be used that are based on the Bernoulli principle, that is, on the different dynamic response with regard to alterations of the flow speed of compressible and incompressible fluids. The use of condensate drains based on the Venturi effect, too, is conceivable.

Figure 5:
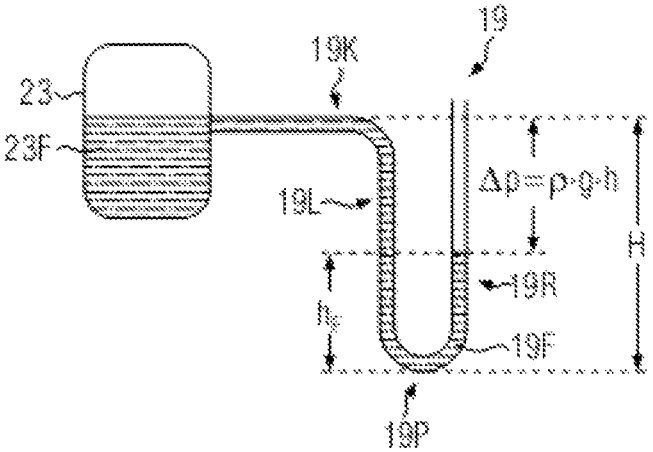
FIG. 5 shows a detailed representation of the separation of condensed liquid according to the embodiment shown in FIG. 3.

FIG. 5 shows a detailed representation of the embodiment already described in connection with FIG. 3. The siphon 19 receives liquid diverted, separated from the device, e.g. a pipeline 12. The U-pipe-shaped siphon 19 is filled with liquid up to a height hF. The siphon 19 is substantially formed of two U-pipe-shaped halves connected to one another. The right half is designated with reference number 19R. The left half is designated with reference number 19L.

The two halves of the siphon 19 are arranged substantially vertically. The left half 19L extends up to a height H, where another pipe 19K is bent off substantially horizontally. The pipe 19K passes the liquid 19F from the siphon 19 into the feed container 23. The liquid level 23F in the feed container 23 is as high as height H. A pressure difference $\Delta p$ at the siphon 19, i.e. on, respectively in, the right half 19R of the siphon 19, is calculated from the product of the density p of the liquid, the gravitational acceleration g and the height difference h of the liquid columns. At normal pressure differences, for example, height differences of some 10 cm to approximately 1 m ensue. However, greater or smaller height differences may be possible, too. Above height $h_F$, i.e. in the region of height h, the right half 19R of the siphon 19 contains substantially only vapor, while substantially only liquid is contained below the height $h_F$.

Figure 6:
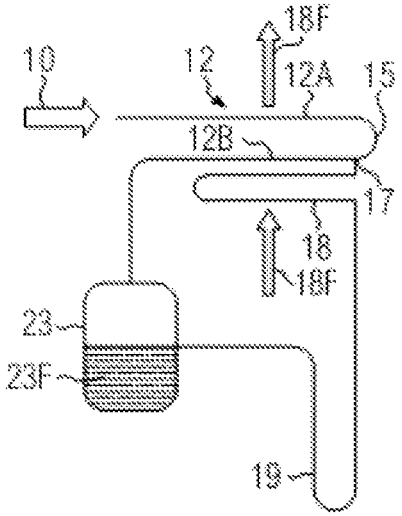
FIG. 6 shows a further development of the device for condensation shown in FIGS. 3 and 5.

FIG. 6 shows another further development of the embodiment depicted in FIGS. 3 and 5. Like elements are provided with like reference numbers. Downstream of the branch element 17 another pipeline 18 is shown in FIG. 6, before the liquid diverted at the branch element 17 is transferred to the siphon 19. The further pipeline 18 is substantially flown through by diverted liquid. In addition, a cooling device for cooling the liquid may be used in this area. In FIG. 6 a cooling flow, e.g. an airflow, is shown by arrows 18F. Due to the heat of condensation ensuing in the device for condensation the device is frequently provided with a cooler. Also, a heat exchanger may be used so as to heat up another liquid/another fluid by means of the heat from the device for condensation. The separated, diverted liquid may be dealt with analogously. Also, it is possible (not shown) to integrate the pipeline downstream of the branch element 17 in a heat transfer packet of the device (not shown), i.e. for example the above-mentioned heat exchanger. Thus, it is possible, on the one hand, to control the temperature of the diverted liquid and, in particular, reduce it. On the other hand, this heat, instead of dissipating it to the environment, may be utilized for the heat transfer to other fluids.

Figure 7:
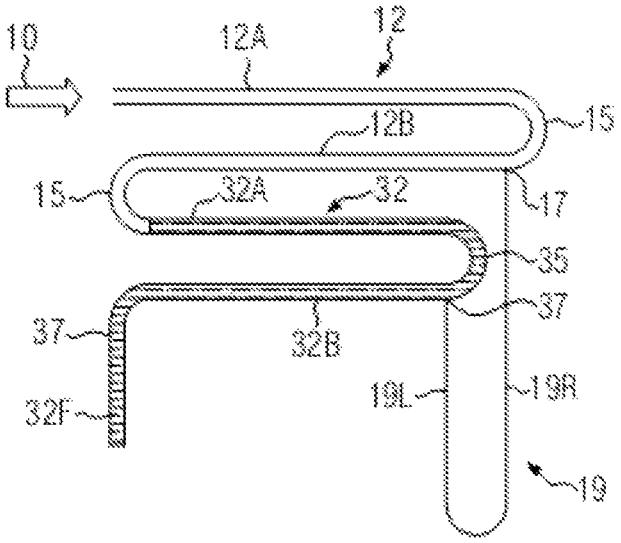
FIG. 7 shows a further development of the device for condensation which is based on the embodiment shown in FIGS. 3 and 5.

FIG. 7 shows another further development of the embodiments depicted in FIGS. 3 and 5 or 6. FIG. 7, again, shows a device similar to the device of FIG. 5. In particular, the device in FIG. 7 comprises, again, a branch element 17 and a siphon 19. However, the liquid contained in the siphon 19 is now not transferred into a feed container, but into another pipeline 32. The reflections regarding the pressure differences as discussed in connection with FIG. 5 apply analogously.

The further pipeline 32 is connected to pipeline 12 by another pipe bend 15. Again, it will be appreciated that two pipelines 12 and 32 have merely been chosen by way of example for illustration purposes, and that it is also possible to use a greater number of pipelines. The pipeline 32 is formed of pipes 32A and 32B and a pipe bend 35. At the orifice 37 the siphon 19, that is, the left half 19L of the siphon, opens into the pipe 32B at the end of the pipe bend 35. The pipeline 32 is substantially filled with liquid, i.e. the pipeline 32 being a part of the device for condensation serves as a liquid collector. A liquid stock 32F is stored in the pipeline 32. The liquid may be transported further from pipeline 32 through another pipe bend 37, which substantially has a 90° deflection. Thus, the pipeline 32 replaces a feed container, or may be used in addition to a feed container (not shown). In use, a sufficiently great quantity can thus be held available typically in the lower portion of the device, i.e. pipeline 32. This stock may vary depending on the load state. In the event of high live steam pressures a high density vapor fills the evaporator as well as the conduits and pipelines. In low load operation more liquid is required, which may be withdrawn from the stock, for example, from pipeline 32.

Figure 8:
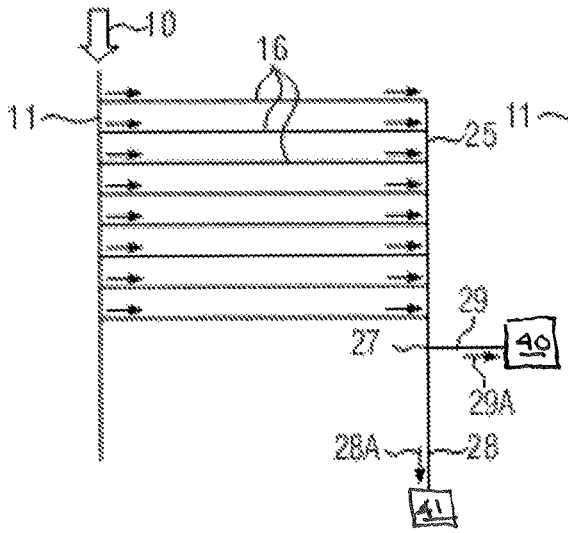
FIG. 8 schematically shows the division of a vapor volume flow at the inlet of a module of a device according to the present invention.

FIG. 8 shows a division of the vapor volume flow at the inlet of the device according to the present invention. The vapor flow 10, vapor, is passed in a conduit 11. The vapor passed in the conduit 11 is distributed to conduits 16. The number of eight conduits 16 as shown should here not be understood as a limitation, but merely as an example. The vapor transferred through the conduits 16, which, as described above, may again be a mixture of the actual working medium and an oil-containing fluid, e.g. an oil-containing liquid, is combined by means of one common collecting conduit 25. The conduit 25 transfers the combined vapor to a branch element/branch 27. From there at least a portion of the vapor can be transferred through the conduit 29 to another module 40 of the device for condensation. The other module 40 may comprise a division of the vapor volume flow, as is shown by way of example for the module according to FIG. 8.

In FIG. 8, for example, condensate/condensed liquid may be transferred through conduit 28 to a further liquid separator 41. Also, it is possible that the conduit 29 is equally provided with a liquid separator (not shown). In both cases the liquid separator may be of the type as discussed in connection with FIGS. 3 to 7. The representation chosen in FIG. 8 shows the relationships of the depicted elements in a plane, that is, the physical arrangement of the elements is not shown. In particular, a liquid separator may physically also be arranged downstream of the plane shown in FIG. 8

Figure 9:
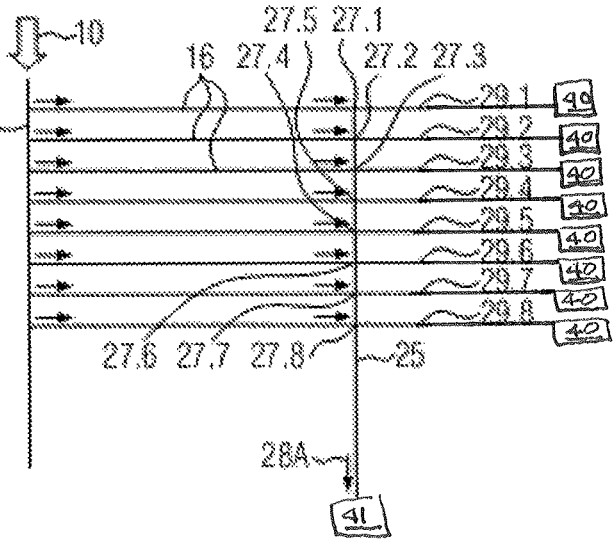
FIG. 9 schematically shows another embodiment of the division of a vapor volume flow at the inlet of a module of a device according to the present invention.
Figure 10:
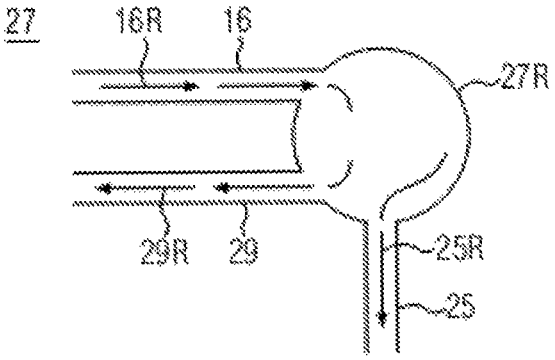
FIG. 10 schematically shows a branch element as may be used in FIGS. 8 and 9.

FIG. 9 shows another further development of the division of the vapor volume flow at the inlet of the device for condensation as described above. Similar to FIG. 8, a vapor flow 10 is transferred into a conduit 11 which distributes the vapor flow to conduits 16 of the same type. In this case, too, it will be appreciated that there is no limitation to eight conduits only. There may also be provided more or fewer conduits. In comparison with the embodiment shown in FIG. 6, each individual one of the conduits 16 comprises a branch element/branch 27.1, 27.2, 27.3, 27.4, 27.5, 27.6, 27.7, and 27.8. Each conduit 16 is connected by its respective branch element 27.1, 27.2, 27.3, 27.4, 27.5, 27.6, 27.7, and 27.8 to a collecting conduit 25. The branch elements 27.1 to 27.8 are shown in FIG. 10 for explanation purposes, as will be discussed below. Similar to the embodiment shown in FIG. 8, condensed liquid can be separated through the collecting conduit 25, for example, in the direction as shown the arrow 28A. This liquid can be transferred, again to a further liquid separator 41. The further liquid separator 41 may be of the type as explained in connection with FIGS. 3 to 7.

Each of the conduits 16 comprises downstream of the respective branch element 27.1, 27.2, 27.3, 27.4, 27.5, 27.6, 27.7, and 27.8 corresponding further conduits 29.1, 29.2, 29.3, 29.4, 29.5, 29.6, 29.7 and 29.8. Through these corresponding further conduits 29.1, 29.2, 29.3, 29.4, 29.5, 29.6, 29.7 and 29.8 vapor not yet condensed in conduits 16 may be transferred into another further module 40 of the device. The further module 40 may, again, correspond to the module shown herein. As was already mentioned in connection with FIG. 8 the representation in FIG. 9, too, shows the relationships of the depicted elements in a plane. In other words, one can talk about a projection onto the plane of projection. A possible physical arrangement of the elements is not shown. In particular, a liquid separator as illustrated in FIGS. 3 to 7 may physically also be arranged downstream of the plane shown in FIG. 9.

FIG. 10 shows by way of example a branch element 27, which is depicted in FIG. 8 or 9. The branch element shown in FIG. 10 may correspond to the elements 27, 27.1 to 27.8 shown in FIGS. 8 and 9. Here, an exemplary conduit is shown, which may correspond to the conduit 16 of FIGS. 8 and 9. A vapor flow is passed in the conduit 16. The direction of flow of the vapor flow is denoted with the arrow 16R. The vapor flow is bent by 180° in the region 27R of FIG. 10 and transferred further through conduit 29. Conduit 29 may correspond to conduits 29 and 29.1 to 29.8 of FIGS. 8 and 9. The bend by 180° is an example. The bend could also be a 90° bend, or another angle could be chosen. It is noted once more that the projection chosen for FIGS. 8 and 9 does not depict this bend. The vapor flow continued downstream of the bend is denoted by the arrow 29R. By the inertia of the liquid transported along in the vapor flow 16R this liquid does not follow the sharp bend, in this case 180°, or at least not entirely, and may flow through conduit 25, for example, by gravitation. The corresponding direction of flow of the liquid is shown by arrow 25R. The conduit 25 then leads to a separator as illustrated in FIGS. 3 to 7.

The invention claimed is:

1. A device for condensation of vapor expanded in an expansion machine of a thermal power plant to a condensed, oil-containing liquid, comprising:

a module for condensation, wherein the module for condensation comprises an inlet and one or more pipelines, including a first pipeline, wherein one or more of said pipelines comprise horizontally arranged pipes;

a liquid separator for separating the condensed liquid;

a liquid collector for collecting the separated, condensed liquid;

a branch element configured to divert at least one portion of the separated, condensed liquid out of the device;

at least one further module for condensation, wherein the at least one further module for condensation comprises a further inlet and one or more further pipelines, wherein the one or more further pipelines comprise horizontally arranged pipes; and a collecting conduit, which is arranged upstream of the liquid separator, and which is configured to combine the expanded vapor after the passage thereof through the one or more pipelines and transfer the expanded vapor further to the further module for condensation, wherein the liquid separator is provided at a location comprising at least one selected from the group of upstream of the first pipeline, at the inlet, and downstream of the first pipeline, and wherein the liquid separator comprises a siphon which is arranged between the branch element and the liquid collector.

2. The device according to claim 1, wherein the liquid separator comprises a condensate drain having a conduit and a float, which is arranged between the branch element and the liquid collector.

3. The device according to claim 1 further comprising a cooling device configured to cool the separated, condensed liquid before the separated, condensed liquid is transferred into the liquid collector.

4. The device according to claim 1, wherein the liquid collector is a feed container, or wherein the one or more pipelines are additionally configured as liquid collectors.

5. The device according to claim 1, wherein the liquid separator is a first liquid separator comprising at least one further pipeline and the device further comprises at least one further liquid separator wherein the further liquid separator is arranged downstream of the at least one further pipeline, and is configured to divert at least one further portion of the separated, condensed liquid out of the device.

6. The device according to claim 1, wherein the collecting conduit comprises a falling gradient towards the liquid separator.

7. A thermal power plant comprising a device for condensation of vapor expanded in an expansion machine to a condensed, oil-containing liquid, the device comprising:

a module for condensation, wherein the module for condensation comprises an inlet and one or more pipelines, including a first pipeline, wherein one or more of said pipelines comprise horizontally arranged pipes;

a liquid separator for separating the condensed liquid;

a liquid collector for collecting the separated, condensed liquid;

a branch element configured to divert at least one portion of the separated, condensed liquid out of the device;

at least one further module for condensation, wherein the at least one further module for condensation comprises a further inlet and one or more further pipelines, wherein the one or more further pipelines comprise horizontally arranged pipes; and a collecting conduit, which is arranged upstream of the liquid separator, and which is configured to combine the expanded vapor after the passage thereof through the one or more pipelines and transfer the expanded vapor further to the further module for condensation, wherein the liquid separator is provided at a location comprising at least one selected from the group of upstream of the first pipeline, at the inlet, and downstream of the first pipeline, and wherein the liquid separator comprises a siphon which is arranged between the branch element and the liquid collector.

8. A method for the condensation of vapor expanded in an expansion machine of a thermal power plant to a condensed, oil-containing liquid, comprising (i) a module for condensation, wherein the module for condensation comprises an inlet and one or more pipelines, including a first pipeline, wherein one or more of said pipelines comprise substantially horizontally arranged pipes, (ii) a liquid separator, (iii) a liquid collector, (iv) a branch element configured to divert at least one portion of the separated, condensed liquid out of the device, (v) at least one further module for condensation, wherein the at least one further module for condensation comprises a further inlet and one or more further pipelines, wherein the one or more further pipelines comprise horizontally arranged pipes, and (vi) a collecting conduit, which is arranged upstream of the liquid separator, the method comprising the steps of:

distributing a vapor volume flow to the one or more pipelines;

separating, at the liquid separator, at least one portion of the condensed, oil-containing liquid at least one selected from the group consisting of upstream and downstream of the first pipeline;

discharging the separated, condensed liquid;

collecting, at the liquid collector, the separated, condensed liquid; and combining, at the collecting conduit, the expanded vapor after having passed through the one or more pipelines; and transferring the combined, expanded vapor to the further module for condensation.

9. The method according to claim 8, further comprising the step of cooling the separated, condensed liquid before the separated, condensed liquid is collected.

10. The method according to claim 8 further comprising the step of separating at least one further portion of the condensed, oil-containing liquid downstream of at least one further pipeline.

* * * * *